United States Patent [19]

Schuster et al.

[11] 4,416,096

[45] Nov. 22, 1983

[54] INSULATING WINDOW INSERT

[76] Inventors: Allan C. Schuster; Georgia L. Schuster, both of 439 E. Main St., Whiteland, Ind. 46184

[21] Appl. No.: 305,758

[22] Filed: Sep. 25, 1981

[51] Int. Cl.[3] ..... E06B 3/26

[52] U.S. Cl. ..... 52/202; 52/406; 49/62

[58] Field of Search ..... 52/202, 203, 309.8, 52/309.9, 406; 160/395, 391, 392; 49/61, 62, 65; 428/71, 76, 189, 192

[56] References Cited

U.S. PATENT DOCUMENTS

| | | | |
|---|---|---|---|
| 2,834,412 | 5/1958 | Velke | 160/395 |
| 4,198,796 | 4/1980 | Foster . | |
| 4,272,934 | 6/1981 | Cowden et al. | 52/309.9 X |

FOREIGN PATENT DOCUMENTS

| | | | |
|---|---|---|---|
| 2059488 | 4/1981 | United Kingdom | 52/203 |

*Primary Examiner*—Carl D. Friedman

*Attorney, Agent, or Firm*—Biebel, French & Nauman

[57] ABSTRACT

An insulating window insert panel provides for vapor and draft barrier functions and also provides for the supporting of a decorative panel or material on the inside surface. The panel is particularly adapted for use with double-hung widows or the like to provide a substantially higher insulating value for the windows so that the heat loss and drafts therethrough may be substantially reduced, and includes a central core or block formed of polystyrene foam which forms a close fit with the window frame and which supports thereon a vapor impervious sheet forming a vapor barrier and a blanket of non-woven fluffy material overlying the vapor barrier sheet for fitting into cracks and crevices and otherwise providing a draft free seal for the window insert, which vapor barrier sheet and blanket are retained at their marginal edges in a circumferential groove and a retaining band carried on the polystyrene core. A decorative panel or sheet may be placed on the inside surface of the window insert unit.

3 Claims, 4 Drawing Figures

INSULATING WINDOW INSERT

BACKGROUND OF THE INVENTION

This invention relates to window insulating units and more particularly to a modular insert unit particularly adapted for use with double-hung windows for increasing the thermal efficiencies of these windows and reducing heat loss.

It has long been known that in older homes the windows and the glass area constitute the single largest areas through which energy is lost to the outside. Older double-hung windows in particular are often ill fitted, worn, and no longer form a tight perimeter seal and many never did in the first instance. When homes were built before the substantial rise in energy costs, it was often more economical to conserve on materials or use less expensive materials. As a result, insulation was used sparingly, if at all, and windows were not provided with proper storm sashes or weatherstripping material. For example, heat loss through a double glass window with an outside temperature of 0° and an inside temperature of 75° F. may be in the order of 155 BTU per hour per square foot. When this is compared with a loss through a R-13 rated wall structure, which may be in the order of 5 BTU per hour per square foot under the same conditions, it will be seen that there exists a need for a low cost product that can be installed at low cost which will convert at least a portion of lossy windows to the equivalent of a high quality wall, and thereby reduce to a substantial extent the overall heat loss and gain from such a building.

Insulating units which are insertable and removable from inside of an existing structure, such as a home, have been suggested as a means by which some or all of the glass area of windows may be covered up and suitably insulated for reducing heat loss and heat gain. However, such prior art units are generally complicated in construction, high in price, or both. Further, many such units do not provide for a vapor barrier nor do they provide structure by which drafts or the like are reduced. They often do not provide for the support of a decorative covering to match curtains or walls or the like, or provide the appearance of a drawn or partially drawn shade to give a natural and comfortable look.

SUMMARY OF THE INVENTION

The present invention is directed to a modular insert composed primarily of plastic type materials having high insulating values, and adapted particularly to be used with double-hung windows. The insert is adapted to cover one or both of the window panels as a module which forms a close draft-proof fit with the window frame on the inside of the window, which not only substantially increases the insulating ability of the window, but also provides a moisture and vapor barrier.

More particularly, the present invention employs a generally rectangular piece or block of essentially rigid foam material, which may consist of a polystyrene or polyurethane resin which has been cut to the desired shape to approximate the opening defined by the window frame which is going to be closed and sealed by the invention. The insert or module further includes a vapor barrier sheet in combination with a blanket of fibrous non-woven material, such as polyester or the like, to form a close fit with the adjacent window framing so that when the insert is positioned within the window opening, the edges are in compression about the top and bottom sills as well as the side frames to form not only a thermal barrier but also a vapor and draft barrier as well.

The invention further includes provision for supporting a sheet or panel of decorative material which may, for example, be cloth, wall paper, window blind material or the like, as desired.

Preferably, to retain the vapor and draft barriers in place, the block of rigid foam is provided with a circumferential groove which receives the tucked in marginal edges of these layers, in combination with an encircling low cost strap which is heat-welded or bonded at its ends or otherwise suitable clamped, to retain the marginal edges securely tucked in.

When the insert of the present invention is in use, the combination provides not only a vapor barrier which seals against outside air infiltration and prevents sweating and condensation on the glass, but also provides a highly effective insulation panel as well as a decorative surface. When the same is installed in a double-hung window, it is possible to obtain an attractive appearance such as that of a window with a half-drawn window shade.

It is accordingly an object of the present invention to provide a low cost modular insert which is characterized by high thermal efficiency.

A further object of the invention is the provision of a modular type insert which includes a core or body formed generally of a block of rigid insulating material such as polystyrene foam, which block also carries an effective thermal and vapor barrier so that the same forms a tight fit within a window opening and which also may carry an inside decorative panel or sheet of material to provide an attractive appearance.

These and other objects and advantages of the invention will be apparent from the following description, the accompanying drawings and the appended claims.

DESCRIPTION OF PREFERRED EMBODIMENT

Figure 1:
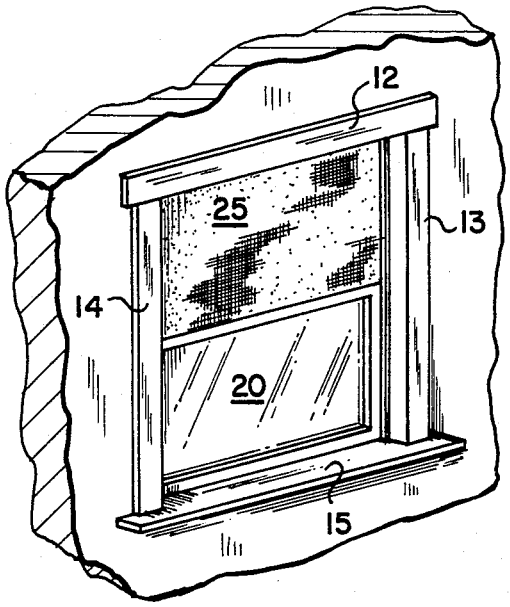
FIG. 1 is a perspective view of my invention installed in a double-hung window.

Referring to the figures of the drawing which illustrate a preferred embodiment of the invention, a conventional double-hung window is illustrated in FIG. 1 as including an upper lentil 12, a pair of side frames 13 and 14 and a lower sill 15. Within the frame defined by the elements 13, 14 and 15 are the upper and lower lights of a double-hung window. The insert of my invention is illustrated at 25 as positioned immediately adjacent to the upper light of the window.

Figure 2:
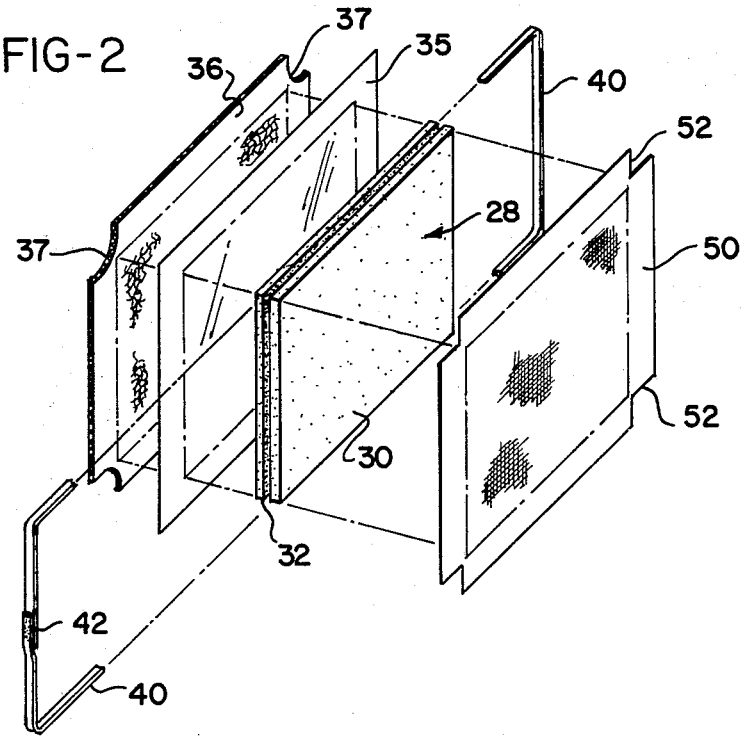
FIG. 2 is an exploded view of the modular insert.

The insert 25 may best be understood by reference to the exploded view of FIG. 2 in which it is seen that the main portion or body of the insert comprises a core or block 28. This core 28 is preferably formed of a block of foamed polystyrene foam or other suitable foam material. Polystyrene foam is of particular advantage in that it is of a closed cell construction, and may be readily formed and cut. Further, the edges may be cut by a suitable hot wire cutter, which not only forms very attractive and smooth edges but also seals the edges and prevents the rough or feathered edges which are commonly formed when material of this kind is simply sawed or cut by a knife. The core or block 28 may have any convenient thickness such as 1", 2", or 3". For a conventional double-hung window it is satisfactory to use a core which has a thickness of 2". The core 28 thus has an outer face 29 (FIG. 3), an inner face 30 and marginal edges which define a circumferential inwardly extending, generally U-shaped channel or groove 32.

Moisture barrier means constitutes a vapor impervious flexible sheet 35 formed with outer dimensions somewhat greater than that of the core 28 and positioned adjacent the outside face 29. The sheet 35 may be formed of any suitable low cost flexible vapor barrier type of material such as polyethylene or polypropylene.

Outside of the sheet 35 I position a further sheet consisting of a blanket or sheet 36 of fluffy fibrous or felt-like non-woven material such as polyester, or similar soft material, which is also formed in a generally rectangular shape, corresponding to the shape and size of the barrier sheet 35 so that its outer dimensions somewhat exceed the core 28. To prevent bunching of materials I preferably cut away or remove the corners as illustrated at 37 in FIG. 2.

Figure 4:
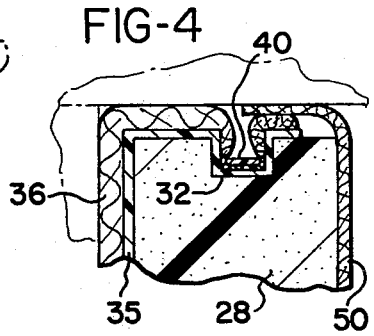
FIG. 4 is an enlarged fragmentary section showing a detail of my invention.

The marginal edges of the sheets 35 and 36 are proportioned to be brought over into overlying relation with the marginal edges of the block 28 and are received within the circumferential groove 32. A plastic band 40 is proportioned to be received in the groove in capturing relation to the sheets of material, as best seen in FIG. 4, and the terminal ends of the band 40 overlapped and heat welded or otherwise clamped together as illustrated at 42, to capture these sheets in assembled relation on the block 28, preparatory to insertion within a window opening.

If desired, a decorative panel 50, formed of any suitable decorative material, may be applied to the front or forward face 30 of the core 28, with cut-out corners 52 to prevent bunching, and inserted with the core assembly. The front panel 50 may thus provide the appearance of a partially drawn shade, or may complement the draperies or may provide any other desired decorative effect. The panel 50 may be readily changed, as desired.

Figure 3:
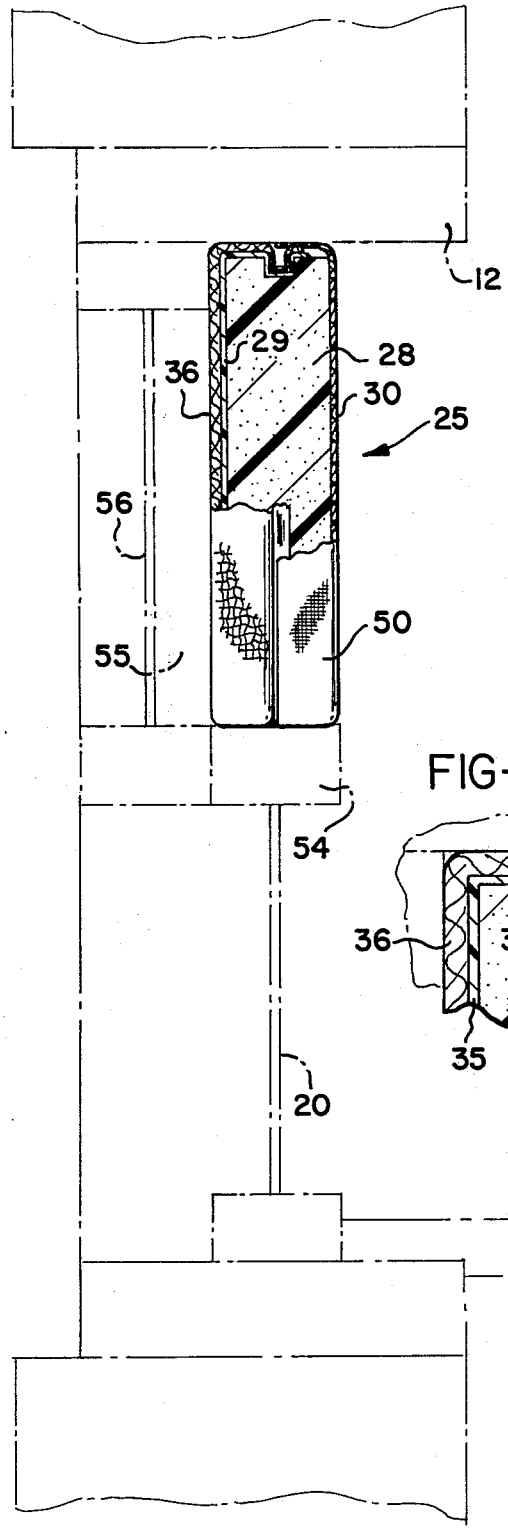
FIG. 3 is an enlarged partially broken away edge view showing the insert within the upper portion of a double-hung window, with the window portions being shown by broken lines.

In the practice of the invention, the window opening to be sealed is accurately measured and a core 28 is cut from foamed polystyrene or the like substantially to the inside dimensions in which the modular unit or insert is to be placed. The vapor barrier sheet and blanket 35 and 36 are put in place and captured by the strap 40. The blanket which may be formed of a fluffy polyester may be ½" thick in its free or relaxed state and thus has the advantage of filling any irregularities in measurement or in physical structure. It may be compressed to a thickness such as not to interfere with the insertion of the panel, and in fact since it is a spongy, springy material, actually aids in the retention of the modular unit or panel when it is in place. The panel is thus proportioned to form a close fit between the lentil 12 and the underlying upper window frame member 54 of the bottom half of the double-hung window, as shown in FIG. 3, and the marginal side edges are proportioned to form a close fit with the window frame members 13 and 14 as shown in FIG. 1 when inserted, a dead air space 55 is formed between the insert 25 and the adjacent glass 56 of the upper window light, as shown in FIG. 3, as closed by the surrounding frame members. Prior to the insertion of the assembled core and sheets 35 and 36, the decorative panel 50 may be inserted in place and the entire unit firmly slid into position as shown by the assembled unit in FIG. 1.

When it is in position, the unit provides a highly effective thermal insulator and vapor barrier for one-half of a double-hung window which will have the effect of reducing the total heat loss through the window by almost 50%. The blanket 36 goes into cracks and crevices and prevents drafts and infiltrations of air and in combination with the barrier, prevents the adjacent window glass and surrounding structure from circulating moisture or sweating or frosting on cold days. On hot days, the rate of heat infiltration by indirect flow or direct rays is substantially reduced providing rooms which are cooler or may be cooled at lower cost. The blanket 36 may be light colored or white to reduce direct heat absorption from the sun. Since in many older residences and buildings, the window or glass loss constitutes the major portion of the wall heat loss, the use of the units of the present invention can provide an effective savings.

While the forms of apparatus herein described constitute preferred embodiments of this invention, it is to be understood that the invention is not limited to these precise forms of apparatus, and that changes may be made therein without departing from the scope of the invention.

What is claimed is:

1. An insulating window insert panel for forming a vapor and draft barrier and for supporting decorative material for use with double hung windows or the like comprising:

a generally rectangularly shaped block of polystyrene foam having a shape adapted to fit between the window sills and window frame members on the sides and in spaced relation to one of the window lights, means in said block forming a peripheral groove, a sheet of vapor barrier material positioned between said block and said window light having a marginal edge received in said groove, a blanket of fluffy polyester material positioned in overlying relation to said vapor barrier sheet and also having marginal edges adapted to be received in said groove, a front sheet of decorative material positioned on the exposed frontal surface of said block and having marginal edges adapted to be received in overlying relation to the edge of said block, and a retainer band encircling said block in said groove gripping the marginal edges of said vapor barrier and said blanket and compressing the same in said groove, whereby said panel may be fitted tightly inside the window frame forming an insulating barrier and vapor shield while supporting decorative material for viewing from the inside of the room.

2. A modular insert for double-hung windows for providing a substantially rigid thermal insulating barrier comprising:

a generally rectangularly shaped block of foamed polystyrene having generally planar front and back surfaces and having a marginal edge defining a longitudinally extending groove therein, a sheet of vapor proof material received on said rear face and having marginal edges adapted to be brought over said marginal edges of said block and received in said groove, a sheet of polystyrene blanket material positioned inwardly of said vapor barrier sheet and having marginal edges adapted to be received in said groove, band means encircling said block in said groove gripping said vapor barrier sheet and said blanket retaining the same in place, and a decorative panel received on the front face of said block.

3. A modular insert adapted to be received within an opening defined by a framed window for providing a substantially rigid thermal and vapor barrier, comprising:

a generally rectangularly shaped block of rigid foamed plastic material having front and back surfaces and having a marginal edge, means defining a layer of vapor impervious material received adjacent said front surface and being formed with marginal edges which are received over the marginal edges of said block, means defining a layer of non-woven compressible blanket material positioned inwardly of said vapor impervious material and provided with marginal edges received over the marginal edges of said block so that the insert forms a close fit with the framed edges of the window and the non-woven blanket material conforms to irregularities in the framing to provide a draft barrier, band means encircling said block, said layer of vapor impervious material and said layer of non-woven compressible blanket material at the respective marginal edges thereof for capturing said materials at said block marginal edges and retaining the same in assembled relationship with said block, and means on the front surface of said block adapted to receive decorative material for viewing from inside of a room.

* * * * *